US006790270B1

(12) United States Patent
Billmers et al.

(10) Patent No.: US 6,790,270 B1
(45) Date of Patent: Sep. 14, 2004

(54) PROTEIN AND STARCH SURFACE SIZINGS FOR OIL AND GREASE RESISTANT PAPER

(75) Inventors: Robert L. Billmers, Stockton, NJ (US); Viotor L. Mackewicz, Califon, NJ (US); Ralph M. Trksak, Manville, NJ (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 27 days.

(21) Appl. No.: 10/395,615

(22) Filed: Mar. 21, 2003

Related U.S. Application Data

(60) Provisional application No. 60/366,589, filed on Mar. 21, 2002.

(51) Int. Cl.[7] ..... C09D 103/02; C09D 103/04; C09D 189/00; D21H 17/71; D21H 19/00

(52) U.S. Cl. ..... 106/145.1; 162/135; 162/174

(58) Field of Search ..... 106/145.1; 162/135, 162/174

(56) References Cited

U.S. PATENT DOCUMENTS

| | | | | |
|---|---|---|---|---|
| 4,280,851 A | | 7/1981 | Pitchon et al. | 127/33 |
| 4,331,547 A | * | 5/1982 | Stotts et al. | 252/62 |
| 4,465,702 A | | 8/1984 | Eastman et al. | 426/578 |
| 4,499,116 A | | 2/1985 | Zwiercan et al. | 426/582 |
| 5,037,929 A | | 8/1991 | Rajagopalan et al. | 426/578 |
| 5,149,799 A | | 9/1992 | Rubens | 536/102 |
| 5,672,699 A | | 9/1997 | Billmers et al. | 536/102 |
| 5,725,676 A | | 3/1998 | Chiu et al. | 127/34 |
| 5,932,017 A | | 8/1999 | Chiu et al. | 127/67 |
| 6,221,420 B1 | | 4/2001 | Thomas et al. | 426/578 |
| 6,231,675 B1 | * | 5/2001 | Chiu et al. | 127/67 |
| 6,372,361 B1 | * | 4/2002 | Mackewicz et al. | 428/537.5 |

OTHER PUBLICATIONS

Modified Starches: Properties and Uses, Wurzburg, r, Chpt. 9, pp. 131–147 (1986), no month provided.

Starch: Chemistry and Technology, 2$^{nd}$ Edition, Whistler, R.L. et al. Editor, pp. 341–343 (1988), no month provided.

Starch Chemistry and Technology, 2$^{nd}$ Ed. Academic Press, Inc., London, Chpt. 9, § 3, pp.324–349. (1984) no month provided.

* cited by examiner

*Primary Examiner*—David Brunsman
(74) *Attorney, Agent, or Firm*—David P. LeCroy

(57) ABSTRACT

A paper sizing and coating composition suitable for use in food packaging that is effective over a range of atmospheric conditions. The composition includes a starch and a water-soluble protein having a bloom strength of at least about 150. The composition can be applied over a paper substrate to improved oil and grease resistance.

21 Claims, No Drawings

PROTEIN AND STARCH SURFACE SIZINGS FOR OIL AND GREASE RESISTANT PAPER

CROSS REFERENCE TO RELATED APPLICATIONS

This application claims the benefit of U.S. Provisional Application No. 60/366,589, which was filed on Mar. 21, 2002.

BACKGROUND OF THE INVENTION

1. Technical Field

This invention relates to paper sizing and coating compositions. More specifically, the present invention relates to compositions suitable for use in food packaging and effective over a range of atmospheric conditions.

2. Background Information

Fluorochemicals such as fluorochemical phosphate salts are typically used to provide oil and grease resistance in food packaging application papers, either internally or as paper sizing agents. However, such chemicals tend to be expensive. Further, fluorochemical treatments often have associated toxicity concerns.

Other components also employed as paper coating and sizing agents include gelatins, starches, modified starches and vegetable proteins. However, these components must be used in expensively large amounts in order to impart sufficient oil and grease resistance. These large amounts make the treated paper stiff and/or brittle for many uses. Additionally, papers treated with gelatins and other protein-containing compositions are often undesirably sticky to the touch under hot and humid atmospheric conditions, and unacceptably brittle under dry atmospheric conditions.

Accordingly, there is a continuing need to provide inexpensive paper sizing agents and coatings that are suitable for imparting non-toxic grease and oil resistance over a range of atmospheric conditions.

SUMMARY OF THE INVENTION

In an attempt to address the above identified issues of cost, amount and property characteristics in paper sizing, the present invention provides a solution based on a combination of starch and water soluble protein having a bloom strength of above 150 suitable for use in paper sizing. The present invention provides a paper surface sizing that is not sticky to the touch at 50% relative humidity (measured at room temperature). If the starch used in the present invention is non-cationic with an amylose content of less than 40%, paper made with the paper sizing of the present invention also exhibits unexpectedly high oil and grease resistance.

Accordingly, the present invention is directed towards a paper surface sizing composition having at least one starch and a water-soluble protein having a bloom strength of above 150. In particular, the invention includes a paper surface sizing composition having non-cationic starch with an amylose content of less than about 40% by weight and gelatin. Especially useful paper surface sizing agents in the present invention include non-cationic hydrophobically modified starches having an amylose content of less than about 40% by weight and gelatin.

The present invention also provides a method of using the above described paper sizing composition to provide oil and grease resistant paper, the process of preparing the paper, and papers prepared thereby.

Finally, the paper sizing agents of the present invention can be used in a sufficiently small quantity that provides an inexpensive paper of acceptable flexibility and that is not sticky, particularly under hot and humid conditions.

DETAILED DESCRIPTION OF THE INVENTION

The paper sizing compositions of the present invention include at least one starch and a water-soluble protein having a bloom strength of greater than 150.

All starches and flours (hereinafter "starch") may be suitable for use herein and may be derived from any native source. A native starch as defined herein is one as found in nature. Also suitable for use herein are starches and flours derived from a plant obtained by standard breeding techniques, such as crossbreeding, translocation, inversion, transformation or any other method of gene or chromosome engineering that include variations thereof. In addition, starch or flours derived from a plant grown from artificial mutations or variations of the above generic composition produced by known standard methods of mutation breeding are also suitable for use herein.

Typical sources of starches include cereals, tubers, roots, legumes and fruits. Native sources can be corn, pea, potato, sweet potato, banana, barley, wheat, rice, sago, amaranth, tapioca, arrowroot, canna, and sorghum. Particularly useful starches include maize, tapioca and potato, especially the waxy versions thereof. As used herein, the term "waxy" is intended to refer to a starch containing at least about 95% by weight amylopectin. The term "high amylose" is intended to refer to a starch containing at least about 40% by weight amylose. Accordingly, a "low amylose" starch is intended to refer to a starch have less than 40% by weight amylose. By definition, this includes the subset of waxy starches. Particularly useful starches in the present invention are low amylose starches. Preferably, the low amylose starch has a water fluidity in the range of from about 20 to about 70.

Useful sizing agents may also include modified versions of any of the aforementioned starches. Modification may be accomplished via physical or chemical substitution on the base starch. Further, more than one type of modification may be used on a single base starch. As used herein, modified starches include, without limitation, crossliniked starches, stabilized starches (i.e., starches which do not undergo retrogradation under freeze-thaw conditions), acetylated and organically esterified starches, hydroxyethylated and hydroxypropylated starches, phosphorylated and inorganically esterified starches, cationic, anionic, nonionic, and zwitterionic starches, and succinate and substituted succinate derivatives of starch. Such modifications and combinations thereof arc known and their preparation are described in the art. See, for example, Whistler, R. L., BeMiller, J. N. and Paschall E. F., STARCH CHEMISTRY AND TECHNOLOGY, 2$^{nd}$ Ed., Academic Press, Inc., London, Chpt. 9, § 3, pp. 324–349 (1984) and MODIFIED STARCHES: PROPERTIES AND USES, Wurzburg, O. B., Editor, CRC Press, Inc., Florida (1986).

Physically modified starches may also be useful in the present invention. These include, without limitation, pregelatinized or thermally inhibited starches. Exemplary processes for preparing pregelatinized granular starches are disclosed in U.S. Pat. Nos. 4,280,851, 4,465,702, 5,037,929, and 5,149,799, the disclosures of which are incorporated by reference. Modification by thermal inhibition is described in the family of patents represented by WO95/04082, which have matured into U.S. Pat. Nos. 5,725,676, 5,932,017, 6,221,420 and 6,231,675, the disclosures of which are incorporated herein by reference.

Starches also suitable for use in the sizing composition of the present invention include conversion products derived from any of the aforementioned starches. Such converted starches include fluidity or thin-boiling starches prepared by oxidation, enzyme conversion, acid hydrolysis, heat and or acid dextrinization, thermal and or sheared products, particularly those starches converted to a water fluidity of between about 20 to about 70. The measurement for water fluidity as referred to herein is made using a Thomas Rotational Shear Type Viscometer (manufactured by Arthur H. Thomas Co, Philadelphia, Pa.). The measurement is made in accordance with standard procedures such as that disclosed in U.S. Pat. No. 4,499,116 to Zwiercan et al., issued Feb. 12, 1985, which patent is incorporated by reference herein.

Particularly useful modified starches are any of the aforementioned starches that are hydrophobically modified with hydrocarbon groups of at least 6 carbon atoms, more particularly 6 to 18, preferably 8 to 12 carbon atoms. This hydrophobically modified starch can be prepared by reacting starch with an organic anhydride reagent and this the following formula:

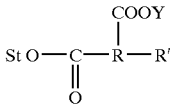

where St is the starch base material, R is a dimethylene or trirnethylenie group, R' is a hydrocarbon group of 6 to 18 carbons, preferably 8 to 12 carbons, and Y is H, alkali metal, alkaline earth metal or ammonium. The hydrocarbon or hydrophobic substituent group R' may be alkyl, alkenyl, aryl, aralkyl or aralkenyl, preferably alkyl or alkenyl, and more preferably alkenyl. The amount of the derivative group bound to the starch, ie.,

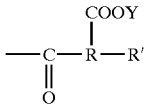

will be from about 1% to about 10% by weight, particularly from about 2% to about 6% by weight, and more particularly from about 3% to about 5% by weight, all percentages based on the weight of dry starch.

The preparation of the hydrophobic starch derivative can be carried out by known procedures. One such method is disclosed in U.S. Pat. No. 2,661,349 to Caldwell et al., issued Dec. 1, 1953, which describes hydrophobic starch derivatives such as starch alkyl or alkenyl succinates. The '349 patent describes an aqueous method in which such derivatives are prepared. A standard esterification reaction is used wherein the anhydride reagent and starch are suspended in water and mixed under alkaline conditions.

Another method for preparing the hydrophobic starch derivatives is disclosed in U.S. Pat. No. 5,672,699 to Billmers et al., issued on Sep. 30, 1997. This patent describes a method for preparing hydrophobic starch derivatives having improved reaction efficiencies wherein the starch and anhydride reagent are predispersed or intimately contacted at low pH before being brought to alkaline reaction conditions.

The disclosures of the preparation of the starch derivatives as found in the above noted '349 and '699 patents are hereby incorporated by reference. Other disclosures of the starch) derivatives and the method of preparation can be found IN STARCH: CHEMISTRY AND TECHNOLOGY, $2^{nd}$ Edition, Whistler, R. L. et al. Editor, pp. 341–343 (1988) and MODIFIED STARCHES: PROPERTIES AND USES, Wurzburg, O. B., Editor, Chpt. 9, pp. 131–147 (1986).

Water soluble proteins suitable for use in the sizing compositions of the present invention include water soluble high molecular weight polypeptides, and can be plant (vegetable) or animal derived proteins as well as synthetic proteins. Examples of such proteins include, without limitation, albumen, amylase amyloglucosidase, arginine/lysine polypeptide, casein, catalase, collagen, crystalline cytochromc C, deoxyribonuclease, elastin, fibronectin, gelatin, gliadin, glucose oxidase, glycoproteins, hexyldecyl ester of hydrolyzed collagen, human placental protein and enzymes, iodized corn protein keratin, lactoferrin, lactoglobulin, lactoperoxidase, lipase, milk protein, hyristoyl glycine/histidine/lysine polypeptide, nisin, oxido reductase, peuicreatin, papin, pepsin, placental protein, protease, saccharomyes, polypeptides, serum albumin, serum protein, sodium stearoyl lactalbumin, soluble proteoglycan, soybean palmitate, urease, subtilisin, superoxide dismutase, sutilainis, and hydrolyzed vegetable protein. Also suitable are proteins derived from soy, egg, peanut, cottonseed, sunflower, pea, whey, fish seafood, sweet almond, wheat germ, wheat, whey, zein, and the like. Particularly useful water-soluble proteins are gelatins derived from animal sources such as pork, and that have a bloom strength of greater than 150, particularly greater than 200, and more particularly greater than 250.

The starch should be fully dispersed in water before use or application. Typically, the starch is cooked above about 80° C., and preferably from about 100 to about 160° C. This can be accomplished by jet cooking or steam injection batch cooking, with jet cooking being preferred. The gelatin can be added either before or after cooking (dispersing) the starch. If the gelatin is added after dispersing the starch, it should be pre-dissolved according to procedures well known in the art.

The starch dispersion preferably has a viscosity range of from about 10 centipoise ("cP") to about 500 cP, particularly from about 20 cP to about 100 cP, and more particularly from about 30 cP to about 50 cP. Viscosity measurements are measured at a temperature of about 150° F. on a Brookfield model DVM Programmable Rheometer. The rheorneter is equipped with a Brookfield Thermosel model HT-110 using spindle numbers SC4-21 and SC4-31. Viscosity sweeps are run at 25 revolutions per minute ("rpm"), 50 rpm, 75 rpm and 100 rpm, which correlates to measurements taken in the shear rate range of 8.5 to 93 1/sec. Because of viscosity requirements associated with application of size dispersions, the concentration of the starch/gelatin blend in water will be from about 2 to about 25%, preferably from about 5 to about 15% and more preferably from about 7 to about 12% by weight.

The starch coating or size dispersion is applied to a previously prepared paper or paperboard web (paper substrate) by any conventional coating and surface sizing technique. These techniques include, without limitation, size press, tub, gate roll and spray applicators and calendar stack sizing procedures, with spray and size press being preferred. For example, in a size press technique, surface sizing is accomplished by passing the web of paper between a pair of press rolls where the lower roll of the pair is rotating in a batch of the sizing dispersion. The surface of this lower roll picks up size and deposits it on the lower surface of the web.

If desired, the coating or sizing can also be applied to the upper surface of the web by pumping it into the nip formed between the web and the upper roll, or by spraying it against the surface of the upper roll and allowing it to accumulate on the upper surface of the web as it enters the press. For example, the starch composition can be pumped and sprayed through a nozzle, atomizing it so that it can be applied uniformly to the sheet or web. Atomizing or misting by mechanical action may also be utilized. The coated or sized webs can then be dried by any conventional drying operation selected by the practitioner to remove substantially all of the moisture.

The coating and surface size composition of the present invention can be successfully utilized for coating and sizing paper and paperboard prepared from all types of cellulosic and non-cellulosic fiber, as well as combinations of cellulosic and non-cellulosic fiber. Also included are sheet-like masses and molded products prepared from cellulosic and non-cellulosic materials derived from synthetics such as polyamide, polyester and polyacrylic resin fibers, as well as from mineral fibers such as asbestos and glass. Hardwood or softwood cellulosic fibers that may be used include bleached and unbleached soda, neutral sulfite, semi-chemical, groundwood, chemi-groundwood, and any combinations of these fibers. In addition, synthetic cellulosic fibers of the viscose rayon or regenerated cellulose type can also be used, as well as recycled waste papers from various sources.

All types of fillers, pigments, dye and rheology modifiers may be added in the usual manner to the paper product that is to be coated or sized Such materials include clay, talc, titanium dioxide, calcium carbonate, calcium sulfate and diatomaceous earth. Usually, an effective additive amount of up to about 25% by weight can be used.

The paper sizing agents of this invention are ordinarily employed in effective amounts that provide a coating or size concentration ranging from about 0.25 to about 15.0% starch/gelatin blend by weight, finished dry paper. Preferably, the paper sizing agents provide a concentration from about 0.5 to about 5.0% by weight based on the weight of the finished dry paper. Within this range, the precise amount used will depend upon, for example, the type of pulp being utilized, the specific operating conditions, and the particular end use desired for the paper.

Papers of the present invention can be acid or alkaline. Preferably, the papers have a Gurley porosity of greater than about 30 sec/100 cc, particularly greater than about 50 sec/100 cc, and more particularly greater than about 100 sec/100 cc.

Use of the present starch/gelatin blends as coatings and surface sizing agents results in paper having improved water resistance, reduced porosity and increased oil resistance.

The following examples arc presented to further illustrate and explain the present invention and should not be taken as limiting in any regard. All parts and percentages are given by weight and all temperatures in degrees Celsius (° C.) unless otherwise noted.

EXAMPLES

Procedures

Measurement of Bloom Strength

The strength of gelatin is classified according to its "bloom strength". Bloom strength of a gelatin is defined as the force required for a plunger of defined and shape and size to make a 4-mm depression in a gel that has been prepared at 6.67% w/w concentration and chilled at 10° C. in a bloom jar for 16–18 hours. The force, recorded in grams, is measured with a texture analyzer. Gelatins with bloom strength ranging from 50–300 bloom are commercially available.

Application of Sizing Agent

The dispersed starch/gelatin composition was applied to paper at a total concentration of 10% by weight in water at 65° C. using a modified ETM Multiple System Lab Coater, manufactured by Euclid Tool and Machine. The technique of application used is generally known as a metered sized press or film transfer size press, wherein a "film" of the starch dispersion is applied to two oppositely rotating rolls. Paper was passed between the two rolls where the starch film was transferred to the base paper substrate. After application, the paper was dried in an Omega/Arkay photographic drum drier. Application weight onto the paper was determined by the weight difference between the untreated paper and the treated paper. The resulting paper samples were tested for physical properties using the following tests.

Measurement of Low-Pressure Gurley: (Gurley "Density"—TAPPI Std. T460 as of November 1992)

This test measures the rate of 100 cc air passage through a paper section covering the orifice of the Gurley Densitometer in 5 to 1800 seconds. The result of this test is commonly referred to as Gurley seconds when reported as seconds per 100 cc of air through one square inch opening. For values higher than 1800 seconds, a high pressure Gurley densitomoter was used. This apparatus utilizes 10 cc of air at a head pressure of 0.44 PSI versus the 0.18 PSI of the low-pressure apparatus. Results are reported as seconds per 10 cc. All values are corrected to units of sec/100 cc.

Measurement of Oil and Grease Resistance: TAPPI UM-557

This test hereinafter referred to as "The 3M kit" is used to examine the effect of viscosity and polarity of the relevant test oil on the ability of the treated paper to resist penetration and wicking of oily substances.

EXAMPLE 1

Preparation of Co-processed Starch/Gelatin Paper Sizing

This example illustrates the preparation of the paper sizings of the present invention via simultaneous cooking of die starch and gelatin.

Starch (100 gm, anhydrous) was suspended in 680 g of tap water at 20° C. Twelve (12) grams (10% based on starch) of gelatin was added to the starch slurry. The mixture was stirred until homogeneous. The suspended sample was then dispersed by continuous steam injection jet cooking where the starch/gelatin slurry is pumped into a stream of steam in a "cooking chamber" at a pressure of 67 psia and at a temperature of 148° C. The sample was collected and cooled to 65° C., and was diluted to 10% by weight in water for application.

EXAMPLE 2

Preparation of Paper Sizings via Post Addition of Gelatin to Starch Dispersion This example illustrates the preparation of paper sizing agents according to the present invention by post addition of gelatin to a starch dispersion.

Starch was jet cooked by slurrying 120 grams of starch (anhydrous) in 680 g of tap water at room temperature. The suspended sample was then dispersed by continuous steam injection jet cooking where the starch slurry was pumped into a stream of steam in a "cooking chamber" at a pressure of 67 psia and at a temperature of 148° C. The sample was collected and cooled to 65° C., and was diluted to 10% by weight in water.

In a separate step a 10% solution of gelatin was prepared by adding 15 grams of gelatin to 135 g of tap water at room temperature in a 250 mL beaker. The beaker was then placed in a boiling water bath (100° C.) and stirred until the solution reached 90° C., then cooled to 65° C.

A total of 900 g of starch cook and 100 g of gelatin solution were weighed into a container and stirred by hand. The mixture was held at 65° C. until applied on the coater.

EXAMPLE 3

Properties of Sizing Compositions

All 'starch alone' sizing agents reported in this example were prepared by slurrying 90.9 grams of starch in 550 grams of water and cooking the slurry at 280° F. using a jet cooker. The sizing were applied to paper (paper samples 1, 6, 9, 12, 15 and 17), ice., bleached kraft, 30lb/3000 $ft^2$, basis wt. 2% ash, alkaline, with no additional additives, via the application procedure described above.

Sizing agents that included starch and gelatin were prepared for paper samples 2 and 3 by the method of Example 1 and applied to the paper by the same application procedure. The starch and gelatin sizing agents for paper samples 4–18 were prepared by the method of Example 2 and applied to the same type of paper by the same application procedure. For comparison, paper sample 19 was sized with gelatin alone. The Gurley porosity (density) of the unsized paper was 100 sec./100 cc.

The air porosity (Gurley density values) and oil and grease resistance (3M kit test values) of each paper were then measured according to the procedures.

TABLE 1

Sizing Agents prepared with 260 Bloom Pork Gelatin

| Paper Sample # | Starch Types in paper sizing (starch or base starch treated with w/w % reagent) | % w/w gelatin/ starch | Gurley Porosity | 3M Kit test |
|---|---|---|---|---|
| 1 | Hylon ® VII starch treated with 3% OSA | — | 12850 | 4 |
| 2 | Hylon ® VII starch treated with 3% OSA | 10 | 3487 | 4 |
| 3 | Hylon ® VII starch treated with 7% PO | 10 | 879 | 2 |
| 4 | Tapioca (wf = 54) | 10 | 854 | 5 |
| 5 | Tapioca (wf = 40) treated with 3% OSA | 10 | 5580 | 6 |
| 6 | Corn (wf = 50) treated with 3% Acetic Anhydride | — | 930 | <1 |
| 7 | Corn (wf = 50) treated with 3% Acetic Anhydride | 10 | 2320 | 4 |
| 8 | Corn (wf = 50) treated with 3% Acetic Anhydride | 25 | 4500 | 6 |
| 9 | Corn (wf = 50) treated with 5% ethylene Oxide | — | 855 | <1 |
| 10 | Corn (wf = 50) treated with 5% ethylene Oxide | 10 | 2490 | 4 |
| 11 | Corn (wf = 50) treated with 5% ethylene Oxide | 25 | 8370 | 8 |
| 12 | Waxy Corn (wf = 45) treated with 3% OSA | — | 13300 | 3 |
| 13 | Waxy Corn (wf = 45) treated with 3% OSA | 10 | 7030 | 7 |
| 14 | Waxy Corn (wf = 45) treated with 3% OSA | 25 | 8633 | 9 |
| 15 | Waxy Corn (wf = 40) treated with 3% Quat | — | 662 | <1 |
| 16 | Waxy Corn (wf = 40) treated with 3% Quat | 10 | 695 | 2 |
| 17 | Waxy Corn (wf = 40) | — | 850 | <1 |
| 18 | Waxy Corn (wf = 40) | 10 | 710 | 2 |
| 19* | None | 100 | 387 | 7 |

Formulation notations:
Hylon ® VII-high amylose corn starch with about 70% amylose content
OSA-octenyl succinic anhydride
PO-propylene oxide
Quat-3-chloro-2-hydroxypropyl-N,N,N-trimethylammonium chloride All paper samples containing starch and up to 25% gelatin were not sticky to the touch. Further, such paper samples did not stick to each other during storage. In contrast, paper sized with sample 19 (gelatin-only sizing) was somewhat sticky at room temperature and 50% relative humidity. Also, this gelatin-only sizing tended to block (fuse together) during storage.

As illustrated in Table 1, papers coated with both non-cationic, low amylose starch (including waxy starches) and gelatin (e.g., samples 8, 11, and 14) show a dramatic increase in oil and grease resistance (as indicated by greater 3M-kit values) versus papers coated with either just starch or just gelatin. This is particularly true of coatings containing the hydrophobically modified low amylose starches (see in particular, the octenyl succinic anhydride treated starches). This illustrates an unexpected synergy between low amylose starch and gelatin for oil and grease resistance.

In contrast, the combination of high amylose starches with gelatin (paper samples 1–3) afforded no improvement to the oil and grease resistance of paper sized with these compositions as indicated by their 3M kit values. Likewise it can be seen from the data for paper samples 4–18 in Table 1, cationic starch does not show a significant boost in oil and grease resistance with the addition of gelatin (paper samples 15 and 16).

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. A paper sizing composition comprising starch and a water soluble protein having a bloom strength of greater than 150, wherein paper sized with the composition is not sticky to the touch at 50% relative humidity measured at room temperature.

2. The composition of claim 1 wherein the starch is a waxy starch.

3. The composition of claim 1 wherein the water-soluble protein is gelatin.

4. The composition of claim 3 wherein the gelatin is present in an amount of up to about 25%, and the starch is hydrophobically modified with octenyl succinic anhydride and has a water fluidity of between about 20 to about 70.

5. The composition of claim 1 wherein the composition is an aqueous solution having a total solids content of from about 7 to 12% by weight.

6. The composition of claim 1 wherein the starch is a non-cationic starch having less than 40% amylose content and a water fluidity of between about 20 to about 70.

7. The composition of claim 4 wherein the non-cationic, low amylose starch is hydrophobically modified.

8. The composition of claim 1 wherein the starch is a hydrophobically modified starch having the formula:

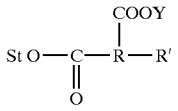

wherein St is the starch base material, R is dimethylene or trimethylene, R' is a hydrocarbon group of 6 to 18 carbon atoms and Y is H, alkali metal, alkaline earth metal or ammonium.

9. The composition of claim 8 wherein R is dimethylene and R' is a hydrocarbon of 8 to 12 carbon atoms.

10. The composition of claim 8 wherein from about 1 to 10% by weight of the group

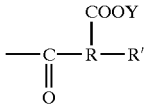

is bound to the starch, based on the dry weight of the starch.

11. A method of providing oil and grease resistant paper comprising coating a paper substrate with a starch and a water soluble protein, wherein the water soluble protein has a bloom strength of greater than 150.

12. A method of preparing a composition for providing oil and grease resistance for a coated paper product, the method comprising the steps of:

suspending starch in an aqueous solution;

mixing a water soluble protein having a bloom strength of greater than 150 in an aqueous solution; and mixing the starch solution with the water soluble solution to form an homogenous mixture.

13. The method according to claim 12 further comprising the step of applying the mixture to a paper substrate thereby providing an oil and grease resistant coating for paper.

14. The method according to claim 13 further comprising the step of drying the coated substrate to remove moisture.

15. The method according to claim 12 wherein the starch is a waxy starch.

16. The method according to claim 12 wherein the starch is a non-cationic starch having less than 40% amylose content and a water fluidity of between about 20 to about 70.

17. The method according to claim 12 wherein the starch is a hydrophobically modified starch having the formula:

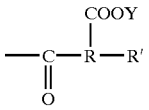

wherein St is the starch base material, R is dimethylene or trimethylene, R' is a hydrocarbon group of 6 to 18 carbon atoms and Y is H, alkali metal, alkaline earth metal or ammonium.

18. The method according to claim 12 wherein the starch is a non-cationic starch having less than 40% amylose content and a water fluidity of between about 20 to about 70.

19. The method according to claim 12 wherein the water-soluble protein is gelatin.

20. The method according to claim 12 wherein the water-soluble protein is added directly to the starch suspension and mixed to form the homogeneous mixture.

21. Paper comprising the composition prepared according to the method of claim 12.

* * * * *